United States Patent [19]

Chen

[11] Patent Number: 4,766,785

[45] Date of Patent: Aug. 30, 1988

[54] PIPE CLAMP

[76] Inventor: Hsi Pin Chen, P.O. Box 32-130, Taipei, Taiwan

[21] Appl. No.: 913,085

[22] Filed: Sep. 29, 1986

[51] Int. Cl.[4] ..... B25B 13/12

[52] U.S. Cl. ..... 81/129; 81/129.5; 81/133; 81/177.2

[58] Field of Search ..... 81/133, 129, 129.5, 81/177.2, 177.1

[56] References Cited

U.S. PATENT DOCUMENTS 4,561,330 12/1985 Chen ..... 81/133

*Primary Examiner*—Robert P. Olszewski
*Assistant Examiner*—Maurina Rachuba
*Attorney, Agent, or Firm*—Morton J. Rosenberg

[57] ABSTRACT

This invention relates to a pipe clamp and in particular to one mainly including a body frame having a fixed jaw on one side thereof and a slot extending therethrough, an adjustable arm extending through the slot of the body frame, an actuating assembly having a toothed member, a driving member mounted into the toothed member and a tongue disposed within a recess of the driving member and pivotally connected with the driving member, spring means urging the tongue against the driving member, and a handle having two prongs between which is sandwiched the body frame, whereby the pipe clamp can be easily and effectively operated to twist a pipe.

3 Claims, 6 Drawing Sheets

PIPE CLAMP

BACKGROUND OF THE INVENTION

The prior art pipe clamp utilizes a theaded ring disposed within a body frame and aligned with a handle to move an adjustable jaw towards the body frame. Hence it can be used to clamp and twist a pipe.

However, it is inconvenient and ineffective to use the threaded ring to move the adjustable arm and this will lower the efficiency of the user.

It is, therefore, an object of the present invention to provide a pipe clamp which can quickly move an adjustable jaw by applying bending force or moment to the body frame and can quickly release the pipe clamp from the pipe.

SUMMARY

This invention relates to an improved pipe clamp.

It is the primary object of the present invention to provide a pipe clamp which is easy to operate.

It is another object of the present invention to provide a pipe clamp which is effective in twisting a pipe.

It is still a further object of the present invention to provide a pipe clamp which is simple in construction.

It is a further object of the present invention to provide a pipe clamp which is inexpensive to manufacture.

These and other object will become apparent when read in conjunction with the accompanying drawings:

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
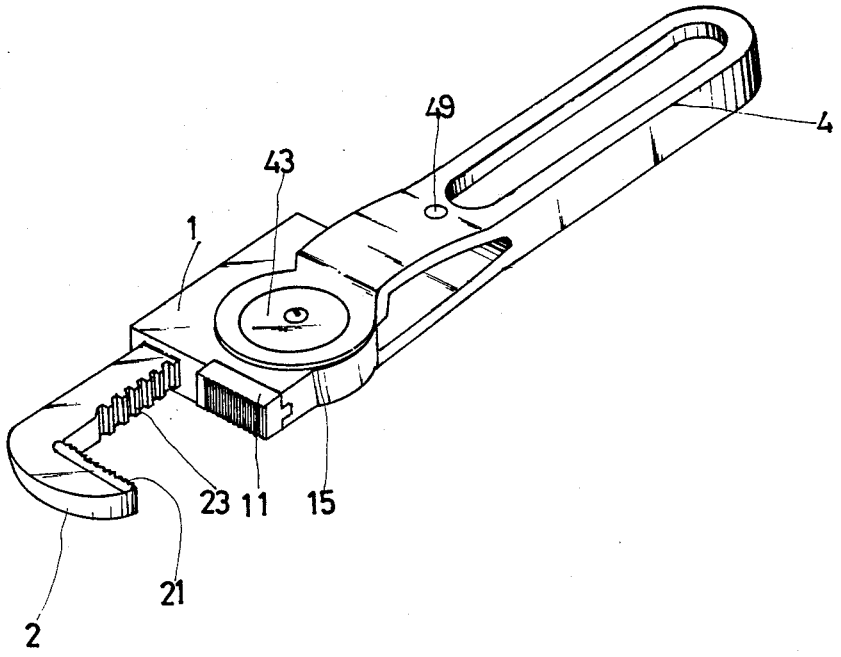
FIG. 1 is a perspective view of the present invention.
Figure 2:
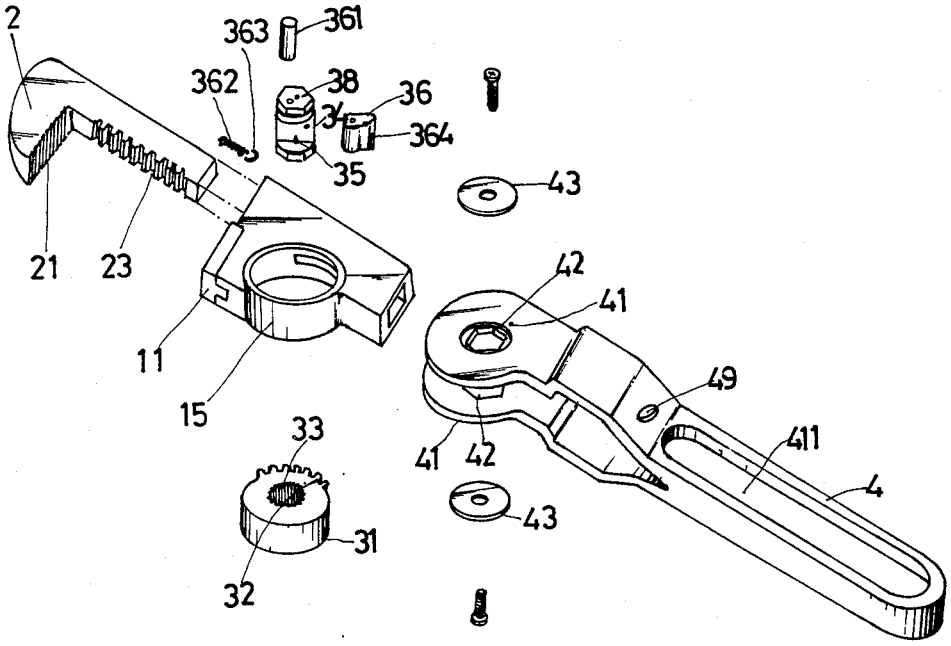
FIG. 2 is an exploded view of the present invention.
Figure 3:
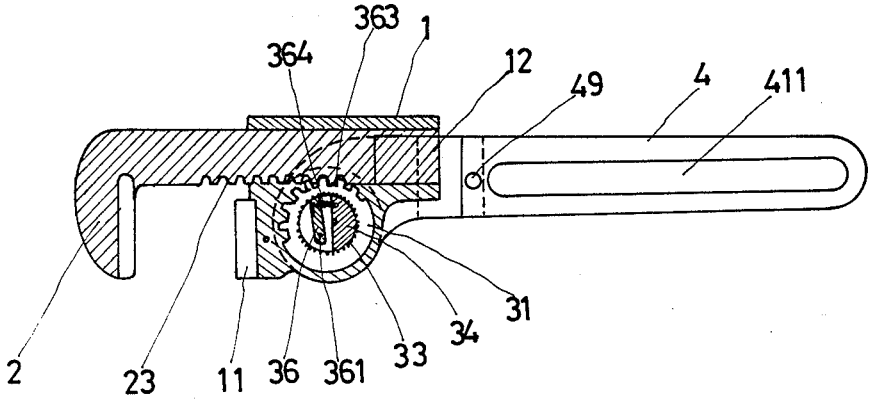
FIG. 3 is a sectional view of the present invention.

With reference to the drawings and in particular to FIGS. 1, 2 and 3, the pipe clamp according to the present invention comprises a body frame 1. The body frame 1 is provided with a fixed jaw 11 on one side thereof and a slot 12 extending therethrough. The body frame is further provided with a vertical circular hole 15 in communication with the slot 12. An adjustable arm 2 having a jaw 21 and a plurality of teeth 23 formed thereon extends through the slot 12 of the body frame 1 and is movable therein. An actuating assembly is also provided. The actuating assembly includes a toothed member 31, a driving member 34 mounted into a recess 33 of the toothed member 31 and a tongue 36 mounted within a recess 35 of the driving member 34 and pivotally connected with the driving member 34 by a pin 36. The toothed member 31, which has external teeth, is disposed in the hole 15 of the body frame and engaged with the teeth 23 of the adjustable arm 2. The tongue 36 has teeth 364 engageable with the internal teeth 33 of the toothed member 31. Furthermore, spring means composed of a spring 362 and a cap 363 is disposed between the tongue 36 and the driving member 34 so that the tongue 36 is pushed against the internal teeth of the toothed member 31 thereby forming a ratchet-like mechanism.

The body frame 1 is sandwiched between two prongs 41 of a handle 4. The handle 4 is provided with two hexagonal holes 42 adapted to the hexagonal portions 38 of the driving member 34. Two washers 43 are each placed on the outer surface of the prong of the handle so as to confine the driving member 34 therein.

When handle 4 is pressed downwards, the hexagonal holes 42 thereof will rotate the driving member 34 and this will push the toothed member 31. Hence the toothed member 31 will rotate which will in turn draw in the adjustable arm 2 thereby clamping the working piece tightly.

When the handle is lifted upwards, the tongue 36 will not push against the internal teeth 33 of the toothed member 31 and the driving member 34 will idle. As a result, it is easy to use the present invention to twist a pipe.

When desired to release the present invention from a pipe (not shown), simply pull the adjustable member 2 outwards with one hand and lift up the handle 4 with the other hand. Therefore, the driving member 34 will not idle and the tongue 36 will urge the toothed member 31 to rotate thereby moving the adjustable arm 2 outwards and therefore, releasing the present invention from the pipe.

Figure 4:
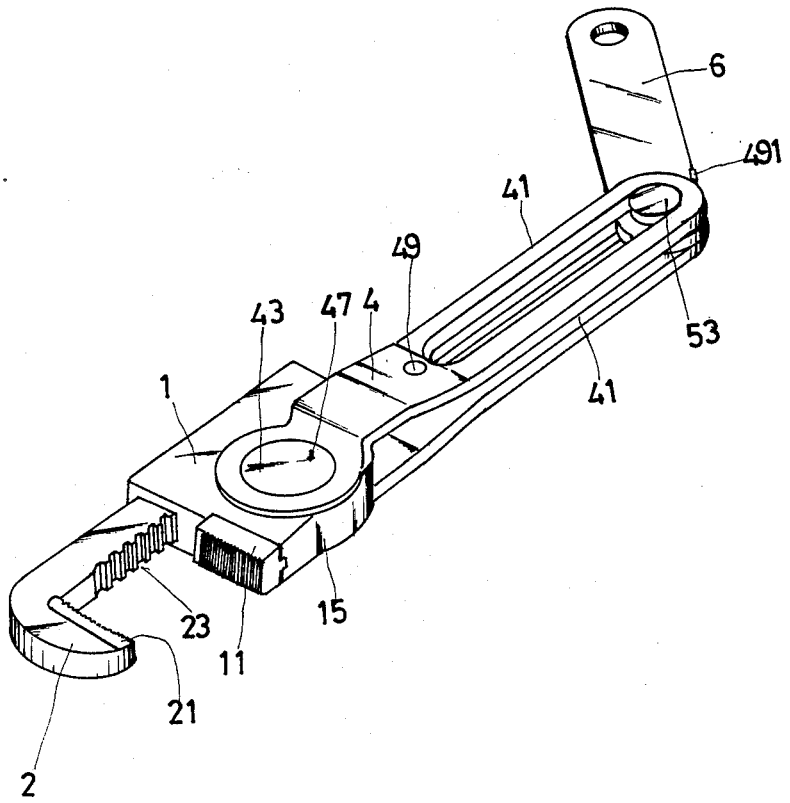
FIG. 4 is a second preferred embodiment of the present invention.
Figure 5:
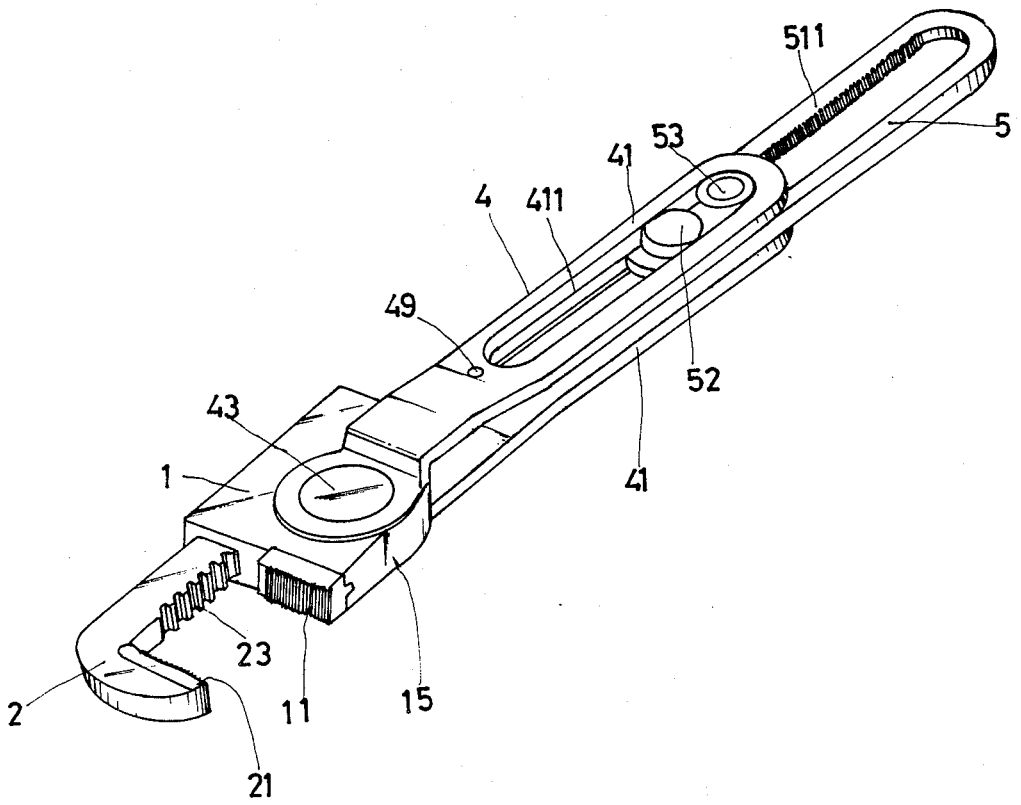
FIG. 5 is a third preferred embodiment of the present invention.
Figure 6:
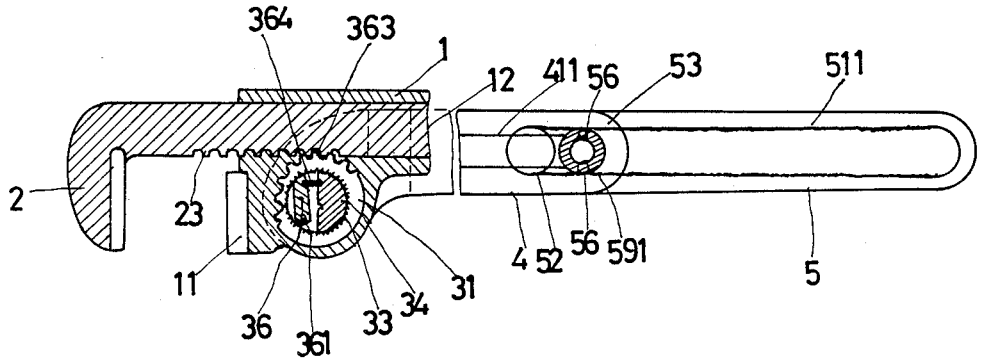
FIG. 6 is a plan view of the third preferred embodiment.

Referring to FIG. 4, there is shown a second preferred embodiment of the present invention. As illustrated, the handle 4 is provided with a wing 6 pivoted on the free end thereof so as to increase the length of the force arm;

Looking now at FIGS. 5 and 6, there is shown a third preferred embodiment of the present invention. The handle is provided with a sliding member 5 having threads 511 engageable with two balls 56 of a stopper 53. The guider 52 is used to keep the sliding member 5 moving along the slot 411 of the handle 4. The sliding member 5 is also designed to increase the length of the force arm.

Although this invention has been described with a certain degree of particularity, it is understood that the present disclosure is made by way of example only and that the arrangement and combination of parts may be resorted to without deporting from the scope and spirit of the invention as hereinafter claimed.

I claim:

1. A pipe clamp comprising:

a body frame having fixed a first jaw on one side thereof and a slot extending therethrough, said body frame being provided with a circular hole in communication with said slot;

an adjustable arm extending through said slot of said body frame, said adjustable arm having a second jaw and a plurality of teeth formed thereon, said adjustable arm being movable within said slot for moving said second jaw relative to said first jaw;

an actuating assembly having a toothed member, a driving member mounted within a recess formed in said toothed member and a tongue disposed within a recess formed in said driving member and pivotally connected to said driving member, said toothed member having (1) external teeth engaged with said teeth of said adjustable arm, and (2) internal teeth formed within said recess formed in said toothed member, said tongue having teeth engageable with said internal teeth of said toothed member;

spring means for biasing said teeth of said tongue against said internal teeth of said toothed member, said spring means being mounted between said tongue and said driving member on opposing ends thereof; and, a handle having two prongs between which is sandwiched said body frame at a first end thereof.

2. The pipe clamp as recited in claim 1, wherein said handle includes a wing member for increasing the length of said handle, said wing member being pivotedly mounted between said prongs of said handle at a second end thereof.

3. The pipe clamp as recited in claim 1, wherein said handle includes a sliding member threadedly engaged between said prongs of said handle at a second end thereof, for increasing the length of said handle.

* * * * *